US006161455A

United States Patent [19]

Ping

[11] Patent Number: 6,161,455

[45] **Date of Patent: *Dec. 19, 2000**

[54] ADJUSTABLE PLIER

[75] Inventor: Qiu Jian Ping, Hangzhou, China

[73] Assignee: Great Neck Saw Manufacturers, Inc., Mineola, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/221,960

[22] Filed: Dec. 28, 1998

Related U.S. Application Data

[63] Continuation-in-part of application No. 08/909,645, Aug. 12, 1997, abandoned.

[51] Int. Cl.[7] ..... B25B 7/12

[52] U.S. Cl. ..... 81/358; 81/359; 81/364

[58] Field of Search ..... 81/355, 352, 358, 81/359, 364

[56] References Cited

U.S. PATENT DOCUMENTS

| | | |
|---|---|---|
| Re. 24,465 | 4/1958 | Waterbury . |
| D. 152,478 | 1/1949 | Hutchinson et al. . |
| D. 329,180 | 9/1992 | Warheit . |
| D. 348,190 | 6/1994 | Warheit . |
| 434,409 | 8/1890 | Sutton et al. . |
| 474,987 | 5/1892 | Church . |
| 698,068 | 4/1902 | Snell . |
| 699,234 | 5/1902 | Quinn . |
| 726,013 | 4/1903 | Aue . |
| 1,048,298 | 12/1912 | Daniels . |
| 1,085,198 | 1/1914 | Finney . |
| 1,106,518 | 8/1914 | Matti . |
| 1,110,220 | 9/1914 | Millsap . |
| 1,136,618 | 4/1915 | Robinson . |
| 1,181,654 | 5/1916 | Eifel . |
| 1,244,967 | 10/1917 | Eifel . |
| 1,276,815 | 8/1918 | Ruthven . |
| 1,534,218 | 4/1925 | Jones . |
| 1,542,123 | 6/1925 | Eifel . |
| 1,577,155 | 3/1926 | Anderson . |
| 1,651,216 | 11/1927 | McGill . |
| 1,651,998 | 12/1927 | Clerico . |
| 1,739,715 | 12/1929 | Eckland . |
| 1,781,940 | 11/1930 | Anderson . |
| 1,952,990 | 3/1934 | Kirsch . |
| 2,066,716 | 1/1937 | Cruickshank . |
| 2,250,400 | 7/1941 | Stephens . |
| 2,320,303 | 5/1943 | Ross ..... 81/356 |
| 2,481,007 | 9/1949 | Dugdale . |
| 2,514,130 | 7/1950 | Jones . |
| 2,531,285 | 11/1950 | Manspeaker . |
| 2,576,286 | 11/1951 | Eisenberg . |
| 2,587,263 | 2/1952 | Wortelmann . |
| 2,592,807 | 4/1952 | Jones . |
| 2,595,989 | 5/1952 | Smeltz . |
| 2,714,198 | 7/1955 | Schloetzer . |
| 2,751,801 | 6/1956 | Hostetter . |

(List continued on next page.)

FOREIGN PATENT DOCUMENTS

| | | |
|---|---|---|
| 2456592 | 12/1920 | France . |
| 1093672 | 5/1955 | France . |
| 958459 | 2/1957 | Germany . |
| 969920 | 7/1958 | Germany . |
| 1060330 | 6/1959 | Germany . |
| 2031661 | 6/1970 | Germany . |
| 67463 | 2/1914 | Switzerland . |
| 916413 | 1/1976 | United Kingdom . |

*Primary Examiner*—James G. Smith
*Attorney, Agent, or Firm*—Joseph J. Previto

[57] ABSTRACT

Adjustable pliers having a pair of handles, each handle having ajaw portion, an intermediate portion and a hand-grip portion. The handles intersect each other and are pivotally mounted to each other so that movement of the hand-grip portions in one direction will move the jaw portions in the same direction. A slide extends from one of the intermediate portions and a slot is in the other intermediate portion. The slide extends into the slot and is slidable along the slot. The slide has a jaw portion extending therefrom. A lock assembly is provided on the handle members to lock the two position.

19 Claims, 4 Drawing Sheets

U.S. PATENT DOCUMENTS

| | | |
|---|---|---|
| 2,838,973 | 6/1958 | Peterson . |
| 2,988,941 | 6/1961 | Ortman . |
| 3,005,368 | 10/1961 | Johnson . |
| 3,241,410 | 3/1966 | Paden . |
| 3,252,360 | 5/1966 | Ortman . |
| 3,252,361 | 5/1966 | Ortman . |
| 3,262,343 | 7/1966 | Weller . |
| 3,283,624 | 11/1966 | Neff . |
| 3,357,287 | 12/1967 | Wertepny . |
| 3,600,986 | 8/1971 | Baldwin . |
| 3,793,914 | 2/1974 | Helms . |
| 4,269,089 | 5/1981 | Hastings . |
| 4,304,158 | 12/1981 | Brunosson et al. . |
| 4,438,669 | 3/1984 | Hastings . |
| 4,651,598 | 3/1987 | Warheit . |
| 4,662,252 | 5/1987 | Warheit . |
| 4,802,390 | 2/1989 | Warheit . |
| 4,819,530 | 4/1989 | Lang . |
| 4,893,530 | 1/1990 | Warheit . |
| 5,060,543 | 10/1991 | Warheit . |
| 5,176,049 | 1/1993 | Neff . |
| 5,351,584 | 10/1994 | Warheit . |
| 5,385,072 | 1/1995 | Neff ..... 81/356 X |
| 5,408,904 | 4/1995 | Neff . |
| 5,660,089 | 8/1997 | Chow . |

ADJUSTABLE PLIER

RELATED APPLICATION

This application is a continuation-in-part of pending application Ser. No. 08/909,645 filed Aug. 12, 1997 now abandoned.

BACKGROUND

The present invention relates to adjustable pliers and more particularly to adjustable pliers which are adapted to be locked in a particular position.

A number of patents have issued on adjustable pliers. Applicant is aware of at least the following patents relating to adjustable pliers:

U.S. Pat. No. 4,651,598

U.S. Pat. No. 4,893,530

U.S. Pat. No. 5,351,584

U.S. Pat. No. 4,802,390

U.S. Pat. No. 4,662,252

U.S. Pat. No. 5,060,543

OBJECTS

The present invention is an improvement over adjustable pliers that have been used in the past and has for one of its objects the provision of an improved adjustable plier which is capable of being easily locked in place around a work piece.

Another object of the present invention is the provision of an improved adjustable plier which can be locked in any position with one hand and which does not require the use of two hands.

Another object of the present invention is the provision of an improved adjustable plier which may be automatically locked in a position and automatically opened.

Another object of the present invention is the provision of an improved adjustable plier which may be locked easily in a particular position and easily unlocked from a particular position.

Another object of the present invention is the provision of an improved adjustable plier which is simple and inexpensive to manufacture and simple to use.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention chosen for purposes of illustration and description is shown in the accompanying drawings forming a part of the specification wherein.

DESCRIPTION

Figure 1:
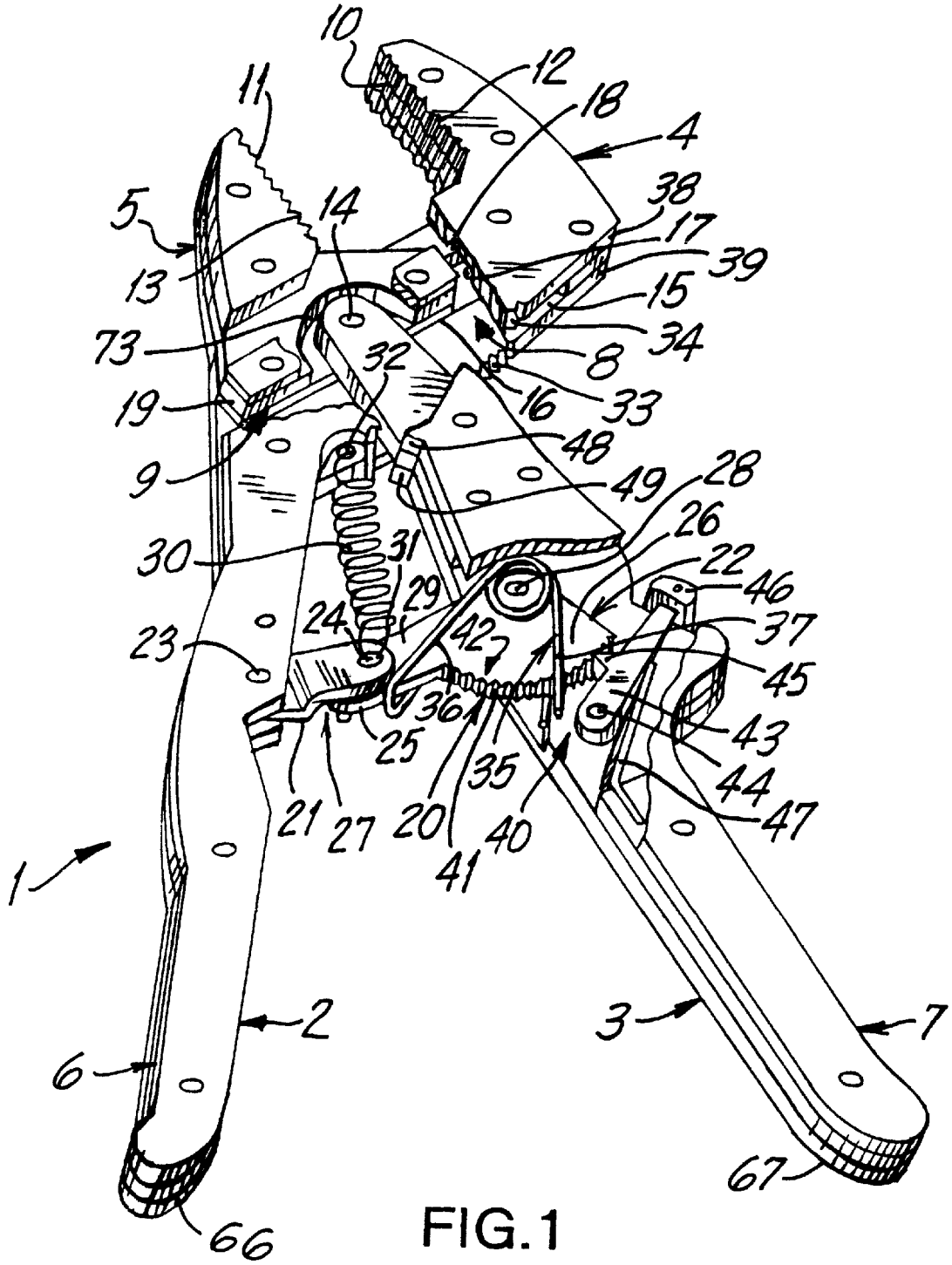
FIG. 1 is a perspective view showing an adjustable plier made in accordance with the present invention.

Referring to the drawings and more particularly to FIG. 1, the improved adjustable pliers 1 of the present invention comprises elongated first and second handle assemblies 2 and 3, respectively. The first and second handle assemblies 2 and 3 each have first and second jaw assemblies 4 and 5, respectively, first and second hand grip assemblies 6 and 7, respectively, and first and second intermediate assemblies 8 and 9, respectively, connecting the jaw assemblies 4 and 5 to the hand grip assemblies 6 and 7, respectively. The jaw assemblies 4–5 may be provided with a plurality of first and second gripping teeth 10 and 11, if desired, along first and second inner edges 12 and 13. The inner edges 12 and 13 with gripping teeth 10 and 11 have been shown in the drawings as being straight. However, it will be understood that the inner edges 12 and 13 may be curved or otherwise contoured, or the inner teeth 10 and 11 may be eliminated without departing from the invention. The first jaw assembly 4 is fixed to the first handle assembly 2 and the second jaw assembly 5 is movable by second handle assembly 3 relative to fixed jaw assembly 4.

The first intermediate assembly 8 has an elongated opening 15 within which the second intermediate assembly 9 of the second handle assembly 3 is positioned so that jaw assemblies 4 and 5 and hand grip assemblies 6 and 7 are juxtaposed in opposite positions to each other. When the hand grip assemblies 6 and 7 are squeezed, the jaw assemblies 4 and 5 are moved toward each other. Teeth 33 and 34 are provided along outer edges 38 and 39 of first intermediate assembly 8 on each side of the opening 15. Spaced holding teeth 48 and 49 are also provided at the forward end of the hand grip assemblies 6 and 7.

A control assembly 20 is pivotally mounted at each end to the hand grip assemblies 6 and 7 at a point between the intermediate assemblies 8 and 9 and the rear ends 16 and 17 of the hand grip assemblies 6 and 7. The control assembly 20 comprises a pair of pivoted arms 21 and 22. The arm 21 which is shown in the drawing as being a yoke extends from and is pivoted to the hand grip assembly 6 by a pin 23. The arm 22 has an end portion 25, a shank portion 29 and a head portion 26. The end portion 25 is pivotally mounted to the free end 27 of the arm 21 by a pin 24. The head portion 26 is larger than the end and shank portion 25 and 29 and is pivotally mounted to the hand grip assembly 7 by pin 28.

A first spring member 30 in the form of a coil spring connects the shank portion 29 of the arm 22 with the intermediate assembly 8 of the first handle assembly 2 through opening 31 and pin 24, respectively, into which the ends of spring 30 enter and embrace. A second straight spring member 35 is wrapped around the pivot 28 of control arm 22 and has its legs 36 and 37 hooked around shank portion 29 and in hand grip assembly 7 to apply opening pressure to the arm 22 and the hand grip assembly 7 which tends to keep the jaws 4 and 5 in their open position. When the hand grip assemblies 6 and 7 are squeezed to close the jaws 4 and 5 around a work piece W, the spring 30 is stretched and the arms 36 and 37 of spring 31 are compressed. As soon as the hand grips 6 and 7 are unlocked and released, the spring 30 will contract and the arms 36 and 37 of spring 31 will expand to open the jaws 4 and 5.

A slot 16 is provided in the intermediate assembly 8 and 9, which is formed by channels 17 and 18 in intermediate assembly 8. A slide assembly 19 is mounted for sliding movement within the slot 16. The forward end of the second intermediate assembly 9 is pivotally mounted in indentation 73 in the slide assembly 19 by pin 14. And the second jaw assembly 5 is mounted for movement with the slide assembly 19 so that when the jaw assemblies 4 and 5 are opening or closing, the slide assembly 19 slides along the slot 16 thereby causing thee second movable jaw assembly 5 to move relative to the fixed first jaw assembly 4. The slide assembly 19 moves in a straight path along above the slot 16 so that movable jaw 5 moves in a straight path relative to fixed jaw assembly 4.

A locking assembly 40 is provided to ensure that the jaw assemblies 4 and 5 are held in a particular predetermined position around a work piece W. The head portion 26 of the control arm 20 has a plurality of teeth 41 on the outer curved surface 42 opposite the pin 28 on which the head portion 26 pivots. A lock-arm 43 is pivotally mounted within the second hand grip assembly 7 member 3 by a pin 44. The lock-arm 43 has a lock-point 45 extending inwardly therefrom toward the teeth 40 of the control arm 20. A finger piece 46 extends upwardly opposite the pivot 44 beyond the outer edge of the second hand grip 7 in order to permit the user to manually move the lock-arm 43 back and forth on pivot 44. The lock-arm 43 is biased towards, and its lock-point 45 is in contact with, the teeth 40 in control arm 20 by means of spring 47 urging it in that direction.

Figure 6:
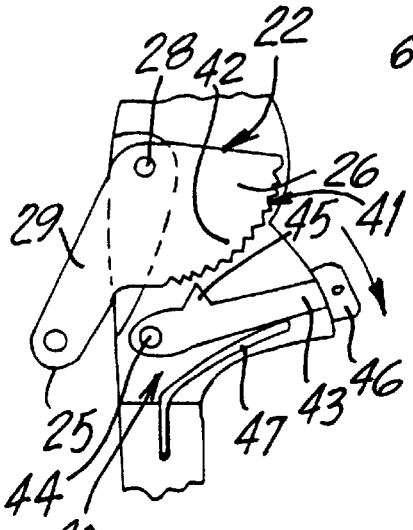
FIG. 6 is an enlarged fragmentary view showing the means for locking and unlocking the jaws.

When the jaw assemblies 4 and 5 are moved together to grasp a work piece W the lock-point 45 rides over the teeth 40 in the head 26 until the jaws 11 and 12 close around a work piece W at which time the lock-point 45 enters a tooth 40 to lock the jaws 11 and 12 in place. This prevents the springs 30 and 31 from opening the jaw assemblies 4 and 5 and locks the jaw assemblies 4 and 5 in a particular position around the work piece W. The spring 30 is stretched as the arms 20 and 21 fold relative to each other in a direction away from the jaw assemblies 4 and 5. To open the jaw assemblies 4 and 5, the lock-arm 43 is moved manually back to the position shown in FIG. 6. This moves the lock-point 45 away from the teeth 40 in the control arm 20, permitting the spring 30 to contract to pull back arms 20 and 21 to their original positions and spring 31 to expand to open the jaw assemblies 4 and 5. This unlocking operation may be performed by the thumb of the user's hand that is holding the tool. Hence, the user may lock and unlock the jaw assemblies 4 and 5 with one hand, thereby leaving the user's other hand free to perform some other function.

Figure 2:
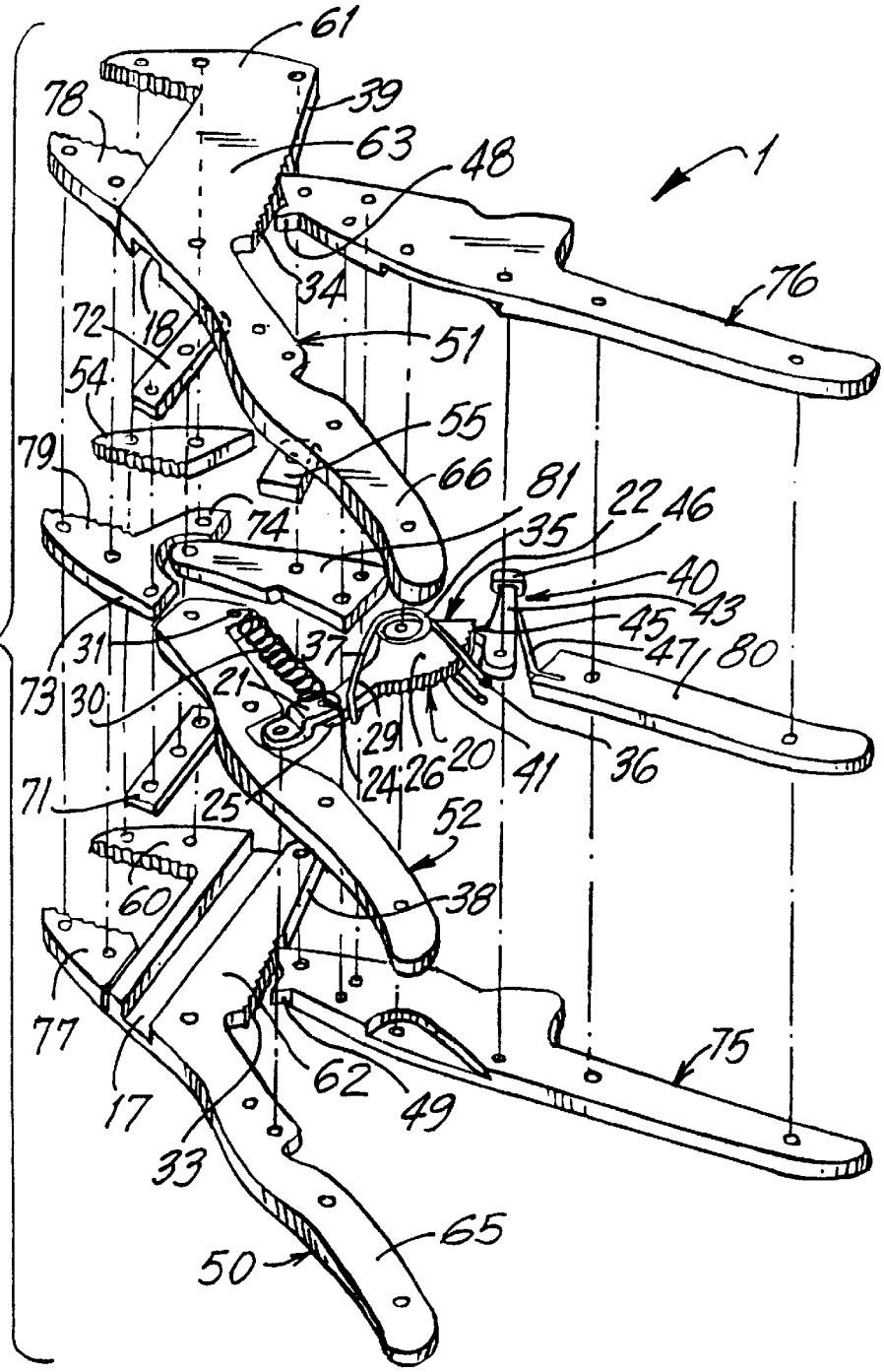
FIG. 2 is an exploded view showing a preferred construction of the adjustable plier shown in FIG. 1.
Figure 3:
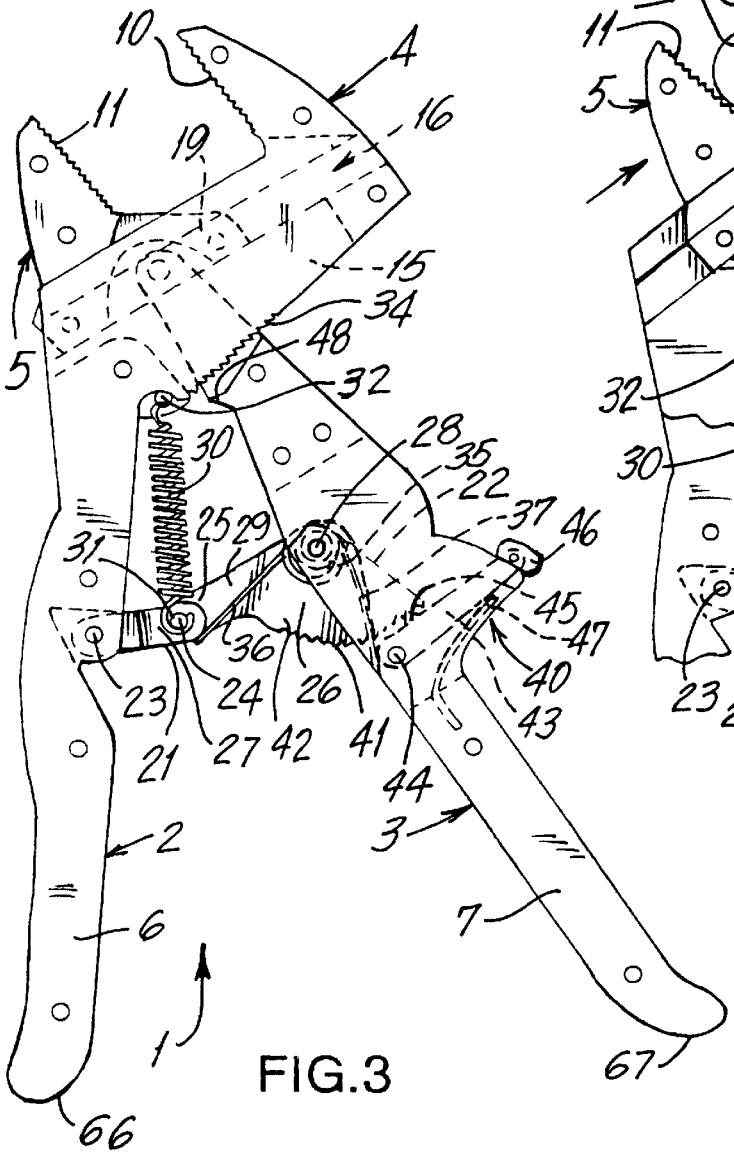
FIG. 3 is a plan view of the adjustable plier showing the position of the parts when the jaws are open.

FIG. 2 shows the preferred structure of the handle assemblies 2 and 3 with their component parts shown as being laminated. However, it will be understood that the handle assemblies 2–3 may be made in one piece or in some other manner then that shown in the drawings without departing from the invention. The first handle assembly 2 comprises a pair of one piece outer laminates 50 and 51, an inner hand-grip laminate 52 and an inner jaw laminate 54. The outer laminates 50 and 51 are shown as having jaw, intermediate and hand grip sections 60 and 61, 62 and 63, and 65 and 66 respectively. The inner jaw laminate 54 conforms to the contours of the jaw sections 60 and 61 of the outer laminates 50 and 5 1 and an inner jaw spacer block 55 is provided between jaw sections 60 and 61. The channels 17 and 18 are formed in the intermediate sections 62 and 63 of the outer laminates 50 and 51 in complimentary relationship to each other to form the slot 16. The inner hand-grip laminate 52 conforms in general to the contours of the hand-grip sections 64 and 65 of the outer laminates 50 and 51 and is spaced from inner jaw laminate 54 and inner jaw spacer block 55 to form the elongated opening 15. It will be noted that the inner hand-grip laminate 52, the inner jaw laminate 54 and the innerjaw space block 55 are interposed between the outer laminates 50 and 51 and are held in place by suitable pins (not shown) or similar holding devices.

The second handle assembly 3 comprises a pair of hand grip outer laminates 75 and 76, a pair of outer jaw laminates 77 and 78, an inner jaw laminate 79 with an inner slide block 74, an inner hand grip laminate 80 and slide control inner laminate 81. The hand grip outer laminates 75 and 76 conform in shape to the inner hand-grip laminate 80. The outer jaw laminates 77 and 78 conform in shape to the inner jaw laminate 79. The slide control inner laminate 81 is spaced forwardly of the inner hand grip laminate 80 and extends forwardly of the outer laminates 75 and 76 and into the opening 15 between the outer laminates 50 and 51. The laminates 75 to 81 are mounted and held together by suitable pins (not shown) or similar mounting means. The inner slide block laminate 74 has an indentation 73 to receive the front of the slide control inner laminate 81. Slide elements 71 and 72 are attached to each side of the inner slide block laminate 74 to form slide assembly 19. It will be noted that there is a space between the slide control laminate 81 and the inner hand-grip laminate 80. This will permit the control assembly 20 and the locking assembly 40 to be mounted and to move between outer laminate 75 and 76.

Figure 4:
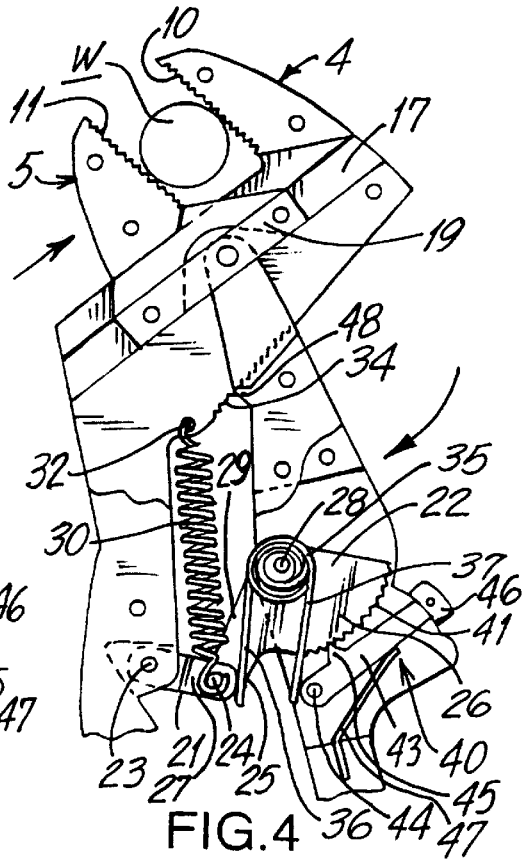
FIG. 4 is a plan view similar to FIG. 3 showing the position of the parts when the jaws are locked around a work piece.
Figure 5:
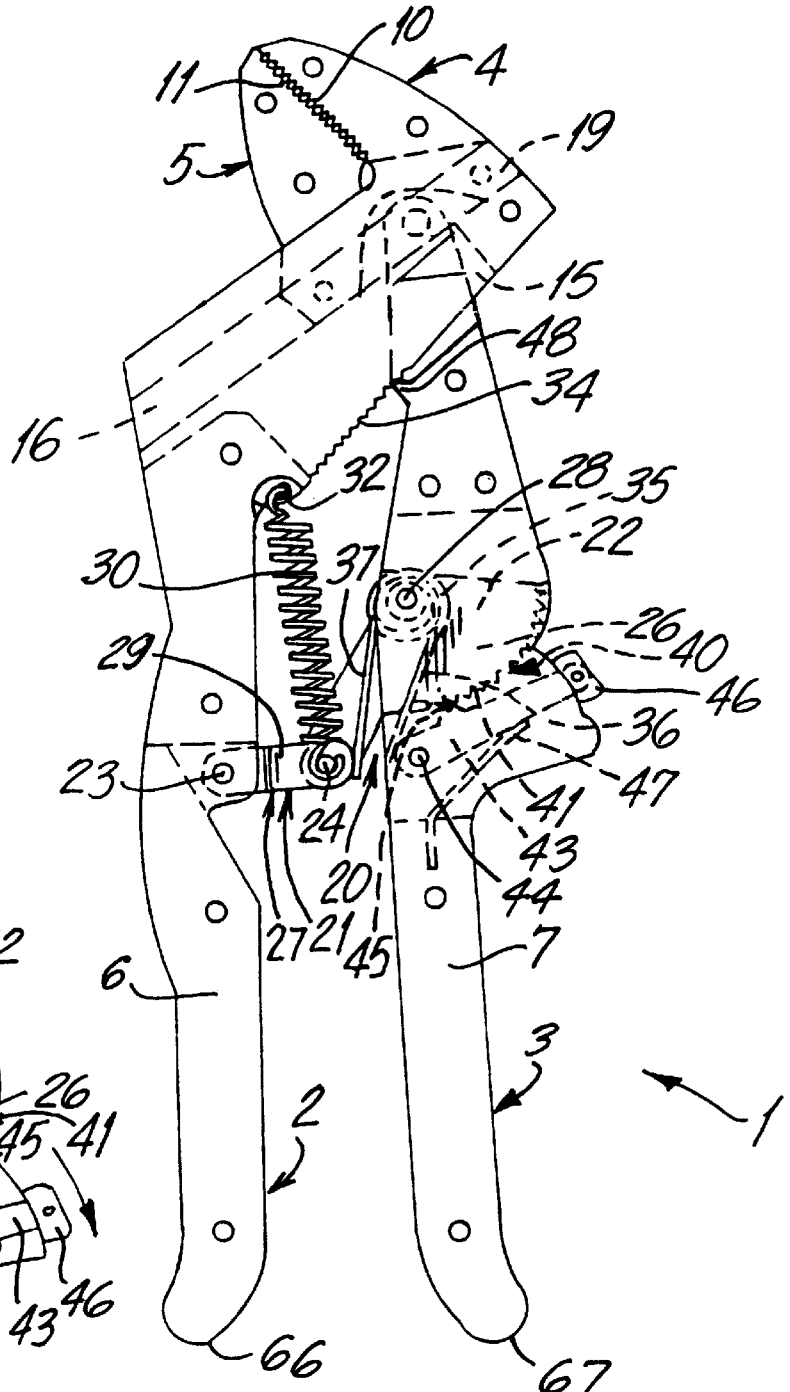
FIG. 5 is a plan view similar to FIG. 3 showing the position of the parts when the jaws are closed.

With this construction it will be seen that when the pliers 1 are to be locked onto a work-piece W (FIG. 4) the jaw assemblies 4 and 5 are moved together by squeezing the hand grip assemblies 2 and 3 so that the slide assembly 19 moves in a straight line along slot 16 until the jaw assemblies 4 and 5 engage the work piece W. The lock-point 45 moves along the teeth 41 of the head portion 26 until the closing of the jaw assemblies 4 and 5 is stopped by the work piece W, at which point the lockpoint 45 enters a tooth 41 in the head 26 and locks the jaw assemblies 4 and 5 in place. With this movement, the spring 30 is expanded and the legs 36 and 37 of the spring 35 are compressed. The holding teeth 48 and 49 of the hand grip assemblies 6 and 7 enter the teeth 33 and 34 of the intermediate assemblies 8 and 9 to help hold the jaws in place. To open the jaw assemblies 4 and 5, the lock arm 43 is manually moved away from the head 26 to move the lock-point 45 out of a tooth 40 in head 26 to release the tool. The spring 30 contracts and the legs 36 and 37 of the spring 35 expand to open the jaw assemblies 4 and 5. The holding teeth 48 and 49 in the hand grip assemblies are moved away from the teeth 33 and 34 in the outer edges 38 and 39 to unlock the jaws.

It will be thus be seen that the present invention provides an improved adjustable plier which can be locked in any position with one hand, which does not require the use of two hands, which may be automatically locked in position, which may be locked easily in a particular position and easily unlocked from a particular position and which is simple and inexpensive to manufacture and simple to use.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. Adjustable pliers comprising a pair of handle members, each handle member having a jaw portion, an intermediate portion and a hand-grip portion, said handle members intersecting each other and being pivotally mounted to each other whereby movement of the hand-grip portions will move the jaw portions, slide means extending from one of said intermediate portions, a slot in the other of said intermediate portions, said slide means extending into the said slot, one of said jaw portions being connected to said slide means, said slide means being slidable along the slot to move one of the jaw portions relative to the other, said slot having opposed parallel side walls, said slide means having opposed parallel side edges, said parallel side edges of the slide means being in close adjacency to the parallel side walls of said slot and locking means for locking the jaw portions in a predetermined position, said slot being at an angle to said jaws, said slide means are pivotally mounted to said intermediate portion, said intermediate portion extends from one end of said slide means and said jaw portion extends from the other end of said slide means, the inner edges of the said jaw portions are substantially parallel to each other whereby slidable movement of said slide within said slot moves the jaw portions at substantially right angles to the inner edges, spring means are provided to open the jaw portions, a control arm assembly connects the handle members together, one end of the control arm assembly is pivoted to one of the handle members and wherein the other end of the control arm assembly is pivoted to the other handle member, said control arm assembly comprises a first arm pivotally extending from one of said handle members and a second arm pivotally extending from the other of said handle members, the ends of said first and second arms being pivotally mounted together.

2. Adjustable pliers as set forth in claim 1 wherein first spring means are provided between said control arm assembly and one of said handle members.

3. Adjustable pliers as set forth in claim 2 wherein second spring means having legs are wound around the pivot of said second arm and wherein the said legs of the spring means are biased in an outward direction, one leg of which exerts pressure on the control arm assembly and the other leg of which exerts pressure on the handle member.

4. Adjustable pliers as set forth in claim 3 wherein said locking means comprise a lock assembly mounted in one of the handle members to lock the jaw portions in position.

5. Adjustable pliers as set forth in claim 4 wherein said lock assembly comprises a lock-point means cooperating with the second arm in order to maintain the jaw portions in a particular position.

6. Adjustable pliers as set forth in claim 5, wherein the second arm has a plurality of teeth and wherein the lock-point means is adapted to be moved into said teeth in order to lock the jaw portions in position.

7. Adjustable pliers as set forth in claim 6 wherein spring-means are provided to bias the lock-point means toward the teeth.

8. Adjustable pliers as set forth in claim 7 wherein moving means are provided to move said lock-point means, said moving means extending beyond the handle member to permit manual movement of the lock point means away from the teeth.

9. Adjustable pliers as set forth in claim 8 wherein teeth are provided in the intermediate portion on one of the handle members and holding teeth are provided on the other handle member, said holding teeth being insertable into said teeth in order to assist in holding the jaw portions in a particular position.

10. Adjustable pliers as set forth in claim 9 wherein said teeth are along the rear edge of the intermediate portion of the handle member and wherein said holding teeth are in the front portion of the said handle member and are adapted to be entered into said teeth.

11. Adjustable pliers as set forth in claim 10 wherein said handle members comprise laminations mounted together.

12. Adjustable pliers comprising a pair of handle members, each handle member having a jaw portion, an intermediate portion and a hand-grip portion, said handle members intersecting each other and being pivotally mounted to each other whereby movement of the hand-grip portions will move the jaw portions, slide means extending from one of said intermediate portions, a slot in the other of said intermediate portions, said slide means extending into the said slot, one of said jaw portions being connected to said slide means, said slide means being slidable along the slot to move one of the jaw portions relative to the other, said slot having opposed parallel side walls, said slide means having opposed parallel side edges, said parallel side edges of the slide means being in close adjacent to the parallel side walls of said slot and locking means for locking the jaw portions in a predetermined position and a control assembly connecting the handles together, said locking means comprise a lock assembly mounted in one of the handle members in order to lock the jaw portions in position, said lock assembly comprises a lock-point means cooperating with the control assembly in order to maintain the jaw portions in a particular position.

13. Adjustable pliers as set forth in claim 12 wherein the control assembly has a plurality of teeth and wherein the lock-point means is adapted to be moved into said teeth in order to lock the jaw portions in position.

14. Adjustable pliers as set forth in claim 13 wherein spring-means are provided to bias the lock-point means toward the teeth.

15. Adjustable pliers as set forth claim 7 wherein moving means are provided to move said lock-point means, said moving means extending beyond the handle member to permit manual movement of the lock-point means away from the teeth.

16. Adjustable pliers as set forth in claim 7 wherein said handle members comprise laminations mounted together.

17. Adjustable pliers comprising a pair of handle members, each handle member having a jaw portion and a hand-grip portion, said handle members intersecting each other and being pivotally mounted to each other whereby movement of the hand-grip portions will move the jaw portions, slide means extending from one of said intermediate portions, a slot in the other of said intermediate portions, said slide means extending into the said slot, one of said jaw portions being connected to said slide means, said slide mans being slidable along he slot to move one of the jaw portions relative to the other, said slot having opposed parallel side walls, said slide means having opposed parallel side edges, said parallel side edges of the slide means being in close adjacency to the parallel side walls of said slot locking means for locking the jaws in a predetermined position, teeth are provided in the intermediate portion on one of the handle members and holding teeth are provided on the other handle member, said holding teeth being insertable into said teeth in order to assist in holding the jaws in a particular position.

18. Adjustable pliers as set forth in claim 17 wherein said teeth are along the rear edge of the intermediate portion of the handle member and wherein said holding teeth are in the front portion of the said handle member and are adapted to be entered into said teeth.

19. Adjustable pliers as set forth in claim 18 wherein said handle members comprise lamination mounted together.

* * * * *